United States Patent [19]

Drolen, Jr.

[11] 4,320,850

[45] Mar. 23, 1982

[54] EASY OPENING END UNIT WITH TAPERED SCORE

[75] Inventor: Fred W. Drolen, Jr., Worth, Ill.

[73] Assignee: The Continental Group, Inc., Stamford, Conn.

[21] Appl. No.: 200,234

[22] Filed: Oct. 24, 1980

[51] Int. Cl.[3] ..... B65D 17/34

[52] U.S. Cl. ..... 220/269

[58] Field of Search ..... 220/268–273

[56] References Cited

U.S. PATENT DOCUMENTS 3,247,997 4/1966 Bozek ..... 220/272

4,148,410 4/1979 Brown ..... 220/269

*Primary Examiner*—George T. Hall

*Attorney, Agent, or Firm*—Charles E. Brown

[57] ABSTRACT

In an easy opening end unit for beverage and like liquid containers wherein the opening tab and displaceable panel portion are non-detachable and the displaceable panel portion is pushed into the interior of the associated can, if the required opening force is not maintained constantly uniform, then there is a tendency for a very rapid movement of the opening tab so as to cause the inwardly displaced panel portion to slap the liquid and to agitate the same, frequently to the extent that part of the liquid is splashed out through the newly formed dispensing opening. The opening force can be made more uniform by varying the score residual.

8 Claims, 10 Drawing Figures

EASY OPENING END UNIT WITH TAPERED SCORE

This invention relates in general to new and useful improvements in easy opening end units, and more particularly to an end unit for a beverage can wherein the end unit is of the non-detachable type and wherein there is a displaceable panel portion which swings into the interior of the container and engages the liquid product disposed therein during the normal opening of the end unit.

End units of the above type are well known and have been in commercial use for some time. The end units do have a certain deficiency in that the displaceable panel portions thereof do swing into the product packaged within the can of which the end unit is a part. If the panel portion is too rapidly moved into contact with the liquid, there is a slapping action on the liquid and this violent agitation of the liquid results in product foaming and splashing with the result that the product frequently splashes out through the newly formed opening in the end unit.

This slapping action has been found to be due primarily to the fact that a certain force is required on the opening tab to initiate rupture and to effect an initial rupture of the scored area around the periphery of the displaceable panel portion. However, after the score is ruptured approximately half of its length or slightly greater, the resistance of the tab to bending and the resistance of the score to rupture suddenly decreases, and thus the force required to continue to move the opening tab toward a fully opened position also suddenly decreases. The net result is that the opening tab is more rapidly moved, and the more rapid movement of the tab results in a quick swinging of the displaceable panel portion into the container and the engagement of the packaged liquid with the aforementioned slapping action.

While it has been known in the past to vary the score residual to prevent displaceable panel blowout under pressure and the like, it is an object of this invention to provide a uniform opening force to prevent improper inward movement of the displaceable panel portion.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
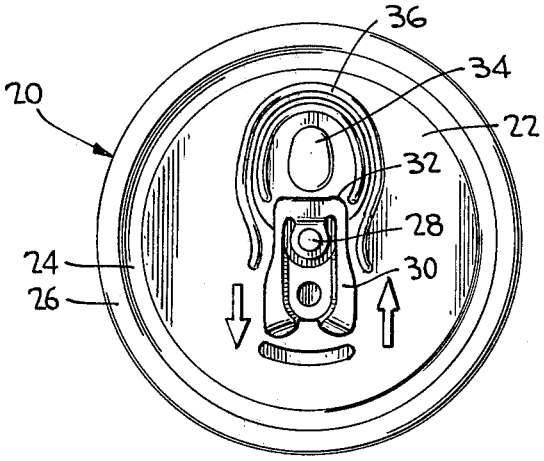
FIG. 1 is a plan view of an easy opening end unit of the type to which this invention relates.

Referring now to the drawings in detail, it will be seen that there is illustrated in FIG. 1 a conventional appearing end unit 20 incorporating this invention. The end unit 20 includes an end panel 22 defined by an upstanding chuck wall 24 which is disposed within a peripheral flange 26 which is utilized in the securement of the end unit to the open end of a can body by way of a conventional double seam.

The end unit 20 is of the easy opening type and is provided with a centrally located rivet 28 which fixedly secures the opening tab 30 to the end panel 22 with a forward portion 32 of the opening tab overlying a displaceable panel portion 34 defined by a score 36.

Figure 2:
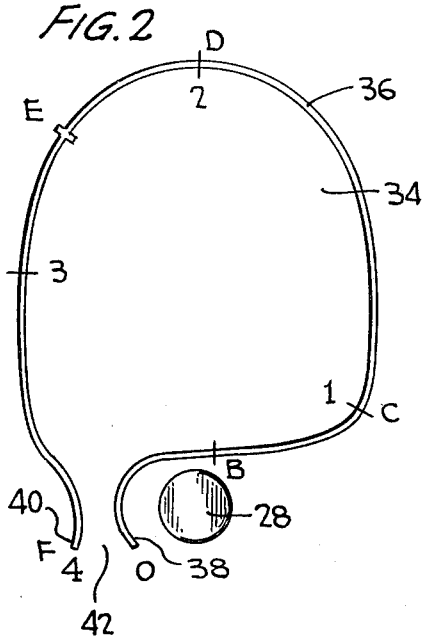
FIG. 2 is an enlarged schematic showing of the score line which defines the displaceable panel portion of the end unit.

Reference is now made to the showing of FIG. 2 wherein the score 36 is illustrated on an enlarged scale. It will be seen that the score 36 is generally oval in outline and has two end portions 38 and 40 which are disposed adjacent to one another and define therebetween a hinge area 42 which permanently attaches the displaceable panel portion 34 to the remainder of the end panel 22. The end portion 38 of the score 36 is the starting end portion, while the end portion 40 is the terminal end portion.

For convenience of description, the score 36 is divided into four quadrants. Identifying points are referred to by the numerals 0–4, with the first quadrant being between the points 0 and 1, the second quadrant being between the points 1 and 2, the third quadrant being between the points 2 and 3, and the fourth quadrant being between the points 3 and 4. In order to describe the relationship of opening force to time, the score in FIG. 2 is also provided with identifying points B–F.

It is to be understood that, because of the location of the rivet 28 adjacent an intermediate part of the first quadrant of the score 36, rupture initially occurs on the score at point B, with the score initially propagating in opposite directions. It is to be understood that after the initial rupture of the score, pressure within the associated can will be vented and that the opening tab 30 will be utilized to push down on the displaceable panel portion 34 and to cause rupture of the score progressively throughout its length with the displaceable panel portion 34 being progressively folded down into the interior of the associated can body. After the score has been ruptured beyond the 12:00 o'clock position, point D, there is a rapid drop-off of the opening force required as is clearly shown with respect to the force-time diagrams of FIGS. 7 and 9.

At point E, the score 36 is temporarily wider than the remainder of the score. This added width of the score is conventionally used to permit a measuring of the score residual.

Figure 3:
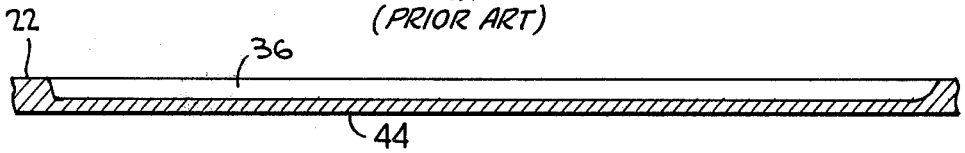
FIG. 3 (PRIOR ART)
FIG. 3 is a developed sectional view through the end unit along the score, and shows various changes in the residual resulting from the score in prior art end unit.
Figure 7:
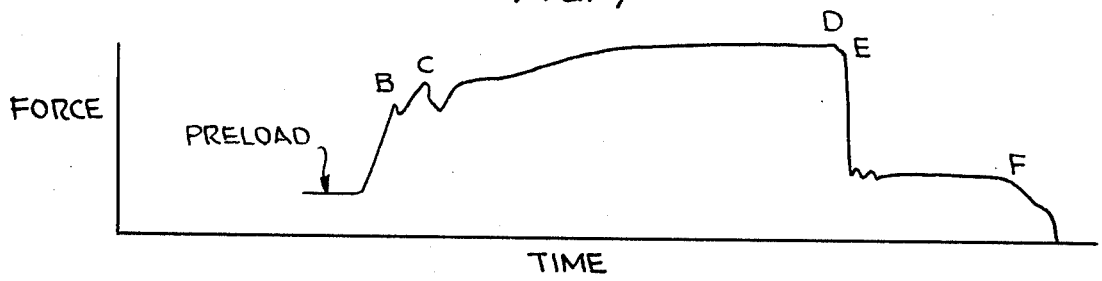
FIG. 7 is a diagram plotting opening force against time with respect to the normal opening of the score of FIG. 3.

With reference to FIG. 3, it is to be understood that the illustrated score corresponds to that tested with the force-time diagram results of FIG. 7. The illustrated score 36 has a uniform residual 44 with the result that the variation force is in accordance with the resistance of the end panel 22 to rupture along the score 36. In particular, with the score arrangement of FIG. 7 there is a rapid drop-off of the opening force required between points D and E, followed by an almost complete drop-off of the opening force at point E.

Figure 4:
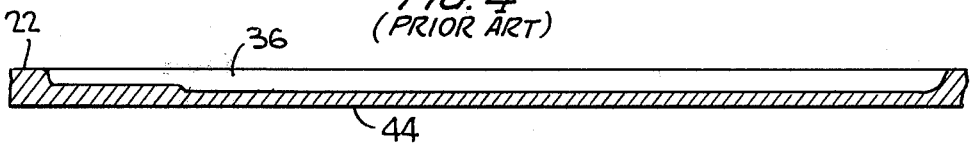
FIG. 4 (PRIOR ART)
FIG. 4 is another developed sectional view through a prior art score wherein there is a step in the initial portion of the score.
Figure 9:
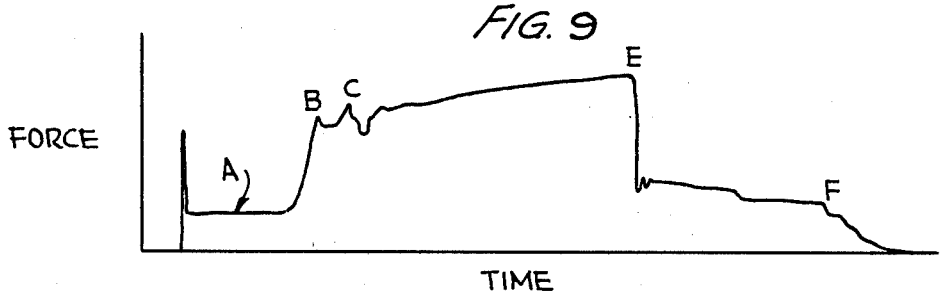
FIG. 9 is another diagram similar to FIG. 7 with respect to the stepped prior art score of FIG. 4.

A somewhat similr drop-off of required opening force simultaneously occurs in the area of points D and E with the stepped score of FIG. 4 as is shown by the force-time diagram of FIG. 9.

When the force requirement suddenly drops off, a person applying the force to effect opening of the end unit is unable to react in time to reduce the applied force with the result that the opening tab 30 is suddenly very quickly moved to a fully opened position with the displaceable panel portion 34 being rapidly advanced into the interior of the can of which the end unit 20 is a part. In view of the projection of the panel portion 34 into the can and the desire to obtain an optimum usage of the space within the can, it is to be understood that in the fully opened position of the end unit 20, the displaceable panel portion 34 will be disposed with its lower part dipping into the liquid packaged within the can. The net result is that the displaceable panel portion 34 actually slaps the upper surface of the liquid as it moves down into the can and causes a violent agitation of the underlying portion of the liquid followed by rapid agitation of the liquid and splashing to the extent that a portion of the liquid will exit through the newly formed opening in the end unit 20.

In order to avoid this splashing and agitation of the liquid, it is necessary that the rate at which the displaceable panel portion 34 is brought into engagement with the packaged liquid must be controlled. In accordance with this invention and starting generally at point E within the third quadrant of the score, or possibly slightly beyond point E, the score residual is gradually increased by upwardly sloping the bottom wall of the score 36.

At the present, the end panels 22 of aluminum end units are of a thickness on the order of 0.013 inch, and the score residual is on the order of 0.0042 inch. This would be the residual of the constant depth score of FIG. 3.

In accordance with this invention, starting in the third quadrant of the score, as described above the depth of the score would progressively decrease and the score residual would progressively increase. It has been found that with the aforedescribed end unit the slope of the bottom of the score 36 should be on the order of 15 minutes. The length of the portion of the score wherein the gradual increase of score residual occurs is on the order of 0.900 inch and, with this particular slope, the score residual would be decreased on the order of 0.004 inch, thus providing at the end of the score a residual on the order of 0.008 inch.

Figure 5:
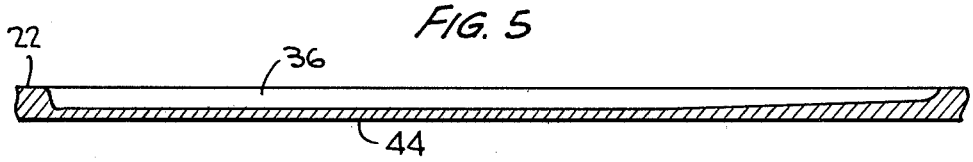
FIG.5 is a developed sectional view along the score showing the score arrangement of FIG. 3, but with the modification of the score residual in accordance with this invention.
Figure 6:
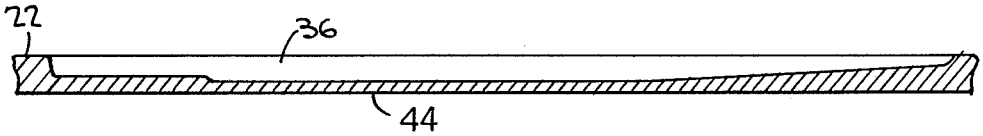
FIG. 6 is a developed sectional view through a score similar to that of FIG. 4, but being provided with a score residual modification in accordance with this invention.
Figure 8:
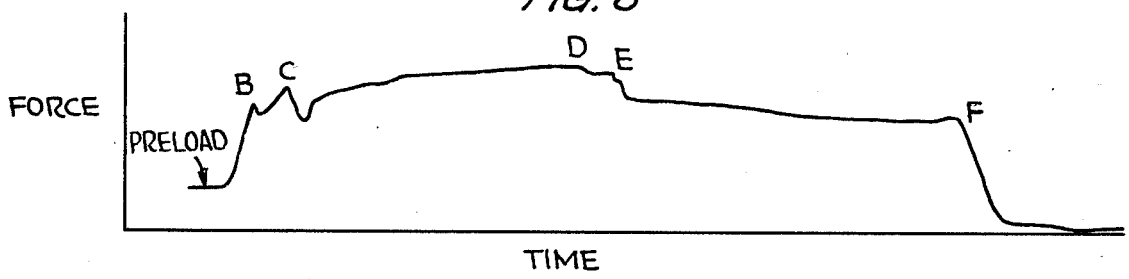
FIG. 8 is a diagram similar to FIG. 7, but with the score arrangement of FIG. 5.

Reference is now made to the score depths shown in FIGS. 4 and 6 which differ from those of FIGS. 3 and 5, respectively. As is shown in FIG. 7, the required opening force is somewhat erratic in the general area of point C. However, by increasing the depth of the score, thereby decreasing the residual, generally in the area of point C, the opening force is made more uniform. Nevertheless, even with this stepped score arrangement, there is still a material decrease in the required opening force in the area of point D. Therefore, in accordance with this invention, the depth of the score is progressively decreased while the residual of the score progressively increases. With the bottom of the score being downwardly offset or stepped, the slope of the bottom of the score may be at a greater angle than the slope in the improvement of FIGS. 5 and 8. The gradual decreasing in the depth of the score will start at approximately the same position adjacent the chuck wall measuring slot break at point E as described with respect to the score of FIG. 5, but will slope upwardly at a greater angle, the angle being on the order of 25 minutes. With the length of the decreasing score depth being on the order of 0.9 inch, the total decrease in the depth of the score will be on the order of 0.0065 inch, thus increasing the residual at the terminal end of the score to be on the order of 0.010 inch.

Figure 10:
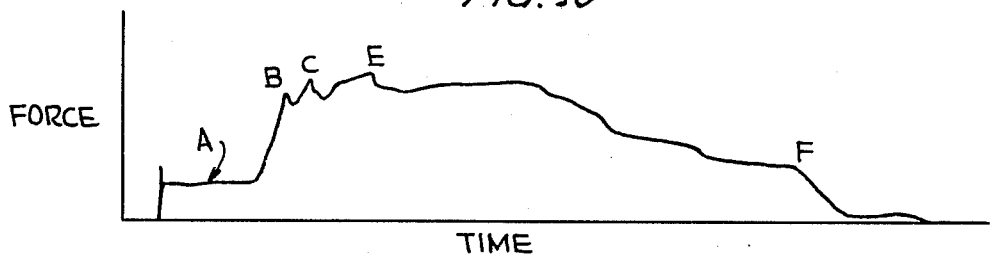
FIG. 10 is another diagram similar to FIG. 7, but with the improved score of FIG. 6.

A comparison of the force-time diagrams of FIGS. 9 and 10 will show a marked difference in the opening force required beginning in the area of point E.

It is to be understood that the depth of the score may be varied in several ways. However, as known to one skilled in the art, the depth of the score may be varied along its length most expeditiously not by variation in the configuration of the score die, but in a variation in the configuration of the supporting anvil.

It is to be understood that the two score arrangements of FIGS. 5 and 6 are merely for illustrative purposes and to describe the best modes of the invention as presently known. However, other score residuals, etc., may be employed without departing from the spirit and scope of the invention as defined by the appended claims.

I claim:

1. In an easy opening end unit of the non-detachable tab type for a beverage can wherein said end unit has a displaceable panel portion defined by a generally oval score having adjacent side-by-side spaced end portions defining a hinge permanently connecting said panel portion to the remainder of said end unit, said score and said tab having a relationship wherein the force required to continue the rupture of said score after opening remains high and then having a normal tendency to suddenly decrease, and said score becoming progressively shallower to define an increasing residual, said increasing residual defining means for resisting the undesired sudden decrease in force required to rupture said end unit and resultant rapid swinging of said panel portion into contact with a beverage underlying said end unit and the resultant foaming and splashing of the beverage, said score including a beginning half and an ending half, and said score becoming progressively shallower in said ending half.

2. An easy opening end unit according to claim 1 wherein said score may be divided into first, second, third and fourth quadrants, and said score becoming progressively shallower in said third quadrant.

3. An easy opening end unit according to claim 1 wherein said score may be divided into first, second, third and fourth quadrants, and said score becoming progressively shallower in said third quadrant and continuing into said fourth quadrant.

4. An easy opening end unit according to claim 1 wherein said score may be divided into first, second, third and fourth quadrants, and said score becoming progressively shallower in said third quadrant and continuing into said fourth quadrant to a terminal end of said score.

5. An easy opening end unit according to claim 2 wherein said score near an end of said first quadrant is downwardly steped to reduce the score residual and thereby maintain the general uniformity of the opening force.

6. An easy opening end unit according to claim 1 wherein said score near a starting end portion is downwardly stepped to reduce the score residual and thereby maintain the general uniformity of the opening force.

7. An easy opening end unit according to claim 1 wherein the angle of said taper is on the order of 25′.

8. An easy opening end unit according to claim 1 wherein the angle of said taper is on the order of 15′.

* * * * *